United States Patent [19]

Krieg

[11] 4,227,495

[45] Oct. 14, 1980

[54] HYDRAULIC LASH ADJUSTER WITH OIL RESERVOIR SEPARATOR

[75] Inventor: John J. Krieg, Battle Creek, Mich.

[73] Assignee: Eaton Corporation, Cleveland, Ohio

[21] Appl. No.: 944,439

[22] Filed: Sep. 21, 1978

[51] Int. Cl.[3] ..... F01L 1/14; F01L 1/24

[52] U.S. Cl. ..... 123/90.55; 123/90.35; 123/90.37; 123/90.43

[58] Field of Search ..... 123/90.48, 90.52, 90.55, 123/90.56, 90.57, 90.58, 90.59, 90.35, 90.37, 90.43, 90.45

[56] References Cited

U.S. PATENT DOCUMENTS

| | | | |
|---|---|---|---|
| 2,962,012 | 11/1960 | Howson | 123/90.59 |
| 3,070,080 | 12/1962 | Van Slooten | 123/90.35 |
| 3,079,903 | 3/1963 | Humphreys | 123/90.59 |
| 3,139,078 | 6/1964 | Van Slooten | 123/90.59 |
| 3,437,080 | 4/1969 | Abell, Jr. | 123/90.35 |
| 3,448,730 | 6/1969 | Abell, Jr. | 123/90.35 |
| 3,717,134 | 2/1973 | Cornell | 123/90.55 |
| 3,782,345 | 1/1974 | Erickson et al. | 123/90.48 |
| 3,838,669 | 10/1974 | Dadd | 123/90.35 |
| 3,875,911 | 4/1975 | Joseph | 123/90.35 |
| 4,083,334 | 4/1978 | Roncon | 123/90.35 |
| 4,098,240 | 7/1978 | Abell, Jr. | 123/90.56 |
| 4,133,332 | 1/1979 | Benson et al. | 123/90.57 |

*Primary Examiner*—Charles J. Myhre

*Assistant Examiner*—Andrew M. Dolinar

*Attorney, Agent, or Firm*—R. J. McCloskey; R. A. Johnston; E. C. Crist

[57] ABSTRACT

A hydraulic lash adjuster for valve gear of an internal combustion engine, the hydraulic lash adjuster being of the type which operates from oil received under pressure from a gallery provided in the engine lubricant supply system to compensate for lash in the valve train. The body of the lash adjuster has a movable plunger assembly provided therein including upper and lower plunger members each having a bore therein which define upper and lower fluid reservoirs, respectively. A one way check valve is located between the lash adjuster body and the lower plunger member. A thin walled, cup shaped metal separator is received in the lower end of the upper plunger member for fluidly isolating the fluid reservoirs. The separator member is held in place by a plurality of outwardly turned retaining tabs extending from the open end thereof which engage the upper end of the lower plunger member. Annular metering passages meter the pressurized engine oil for supplying fluid to the lower and upper fluid reservoirs. A passageway in the top end of the upper plunger member conveys fluid from the upper fluid reservoir to a reaction surface located on the upper plunger member.

5 Claims, 3 Drawing Figures

HYDRAULIC LASH ADJUSTER WITH OIL RESERVOIR SEPARATOR

FIELD OF THE INVENTION

This invention relates to an improved hydraulic lash adjuster for use in an internal combustion engine valve gear, particularly of the type having an overhead cam arrangement with a center pivoted rocker arm. The valve gear arrangements of this type have been found especially suited for smaller displacement, higher r.p.m. engines.

DESCRIPTION OF THE PRIOR ART

A known arrangement for metering oil to the top reaction surface of a hydraulic lash adjuster plunger for lubricating a push rod contact point utilizes a disk shaped member mounted between a plunger reaction element and the main body of the plunger. The disk shaped member usually has a plurality of metering orifices therein for permitting pressurized oil, from a fluid reservoir located in the lower portion of the plunger body, to pass through the orifices. Oil then flows through a bleed hole located in the upper end of the plunger which empties onto the upper plunger element reaction surface.

Another known arrangement for metering oil through the upper portion of a tappet plunger incorporates a free floating cup shaped separater element having a radial groove formed into a peripheral lip which seats against a cooperating surface of the plunger for metering oil.

The above described metering techniques are not, however, adaptable to a lash adjuster having oil metered between the plunger outer diameter and the lash adjuster body bore internal diameter. Since, in such an arrangement it is required to fluidly isolate the lower fluid reservoir from the metered oil flowing through the upper portion of the plunger member to the plunger reaction surface. A further shortcoming of the above described lash adjusters is that the orifices are subject to clogging.

There has arisen a need for a hydraulic lash adjuster which can provide a precisely metered oil flow through annular metering techniques and direct that flow through a bleed orifice which discharges onto a lash adjuster reaction surface.

An additional requirement is that this metered oil flow must be isolated from the primary reservoir which feeds through the lash adjuster check valve.

A further requirement is that the bleed orifice area must be minimized in order to maximize the contact area on the lash adjuster upper reaction surface. Attempts at drilling a relatively small diameter bleed hole through the upper solid portion of a conventional plunger to a depth substantially greater than its diameter in order to intersect with a larger diameter cross or feed hole have been unsuccessful due to drill breakage.

The prior art lash adjusters have failed to provide these features.

SUMMARY OF THE INVENTION

In the present invention a unique hydraulic lash adjuster is provided wherein an upper plunger member and a lower plunger member are slidably received in the lash adjuster body and define respectively upper and lower fluid reservoirs with a thin cup shaped member provided therein to separate the reservoirs. Metered oil flows through an annular metering orifice defined by the clearance between the upper plunger outer diameter and the lash adjuster body internal diameter. The metered oil also flows to a reservoir defined by an upper plunger member where it then flows through a bleed orifice relatively small in diameter and having a minimum length-to-diameter ratio. The cup shaped separator member functions to fluidly isolate the path of the metered oil flow in the upper plunger member from the lash adjuster lower reservoir. Since the upper reservoir is formed in part by the separator, the upper plunger member can be fabricated by cold heading into a relatively thin walled cup shaped plunger element, thereby significantly reducing material usage and consequently the weight of the entire hydraulic lash adjuster. The relatively thin wall of the upper plunger element enables the length to diameter ratio of the bleed orifice to be minimized, thereby facilitating drilling.

It is therefore an object of the invention to provide a means for isolating the lower fluid reservoir from the flow of metered oil through the upper plunger member and to provide a bleed orifice through the upper end of the upper plunger member having a minimum diameter and also a minimun length-to-diameter ratio.

It is a further object of the invention to reduce the weight and material usage of the hydraulic lash adjuster assembly.

Another object of the invention is to provide a separator member which is low in cost and can be assembled and retained in place within the plunger assembly without the need for additional fasteners or additional fastening operations.

A further object of the invention is to provide a precise metered flow to the upper plunger reaction surface which is not prone to clogging.

DETAILED DESCRIPTION OF THE DRAWINGS

Figure 1:
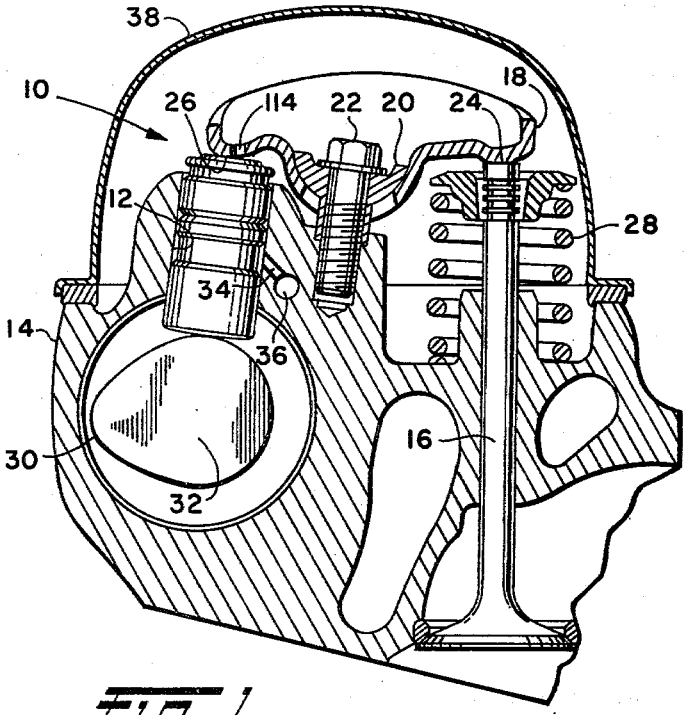
FIG. 1 is a view in elevation of a hydraulic lash adjuster embodying the principles of the invention and shown in association with center pivot rocker arm valve gear of an internal combustion engine.

Referring now to FIG. 1, there is shown generally by reference numeral 10 a hydraulic lash adjuster of the present invention reciprocally mounted in a bore 12 of an internal combustion engine cylinder head 14 having overhead valve gear. Portions of a center pivot rocker arm type valve gear are illustrated including a poppet valve 16 and a rocker arm 18. Rocker arm 18 pivots about a fulcrum member 20 secured to the cylinder head 14 by a retaining bolt 22. Rocker arm 18 contacts the upper end of the poppet valve stem at contact point 24 and contacts the upper end of the hydraulic lash adjuster 10 at contact point 26. A valve spring 28 biases the poppet valve to a closed position while a cam 30 of camshaft 32 acting through hydraulic lash adjuster 10 actuates the poppet valve 16 to an open position. Bore 12 has communicating therewith a suitable oil port 34 which port also communicates with an oil gallery 36 provided in cylinder head 14. The oil gallery 36 is connected by suitable passages (not shown) to the engine oil pressure supply system, and thus supplies engine oil under pressure to the hydraulic lash adjuster 10 as will hereinafter be described in greater detail. Cover housing 37 is connected to the cylinder head and retains the discharged oil therewithin permitting it to return to the engine sump.

Figure 2:
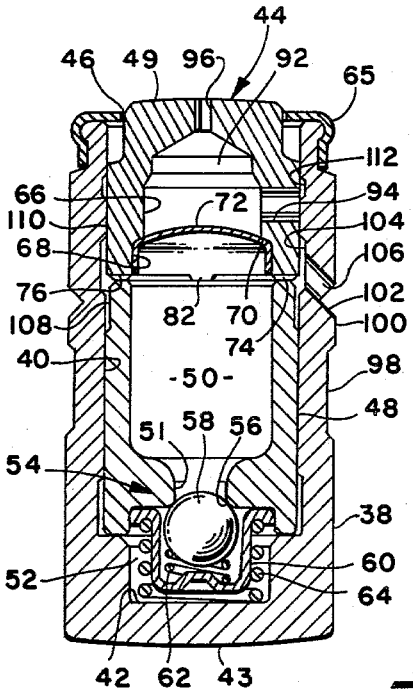
FIG. 2 is a cross sectional view of the lash adjuster of FIG. 1.

Referring now to FIG. 2, the hydraulic lash adjuster 10 is shown as having a body 38 preferably of a cylindrical configuration with a bore 40 having a blind end 42 formed therein. A lower reaction surface 43 is defined by the bottom end of body 38 and is engageable with cam 30. A plunger means 44 is slidably received in bore 40 in close fitting relationship thereto. The plunger means is shown as being formed of two members, an upper plunger member 46 and a lower plunger member 48. An upper reaction surface 49 is defined by the upper end of upper plunger member 46 and is engageable with rocker arm 18 at contact point 26. A lower fluid reservoir 50 is formed by the central hollow portion of lower plunger member 48 with a passage 51 extending longitudinally through its lower end. A chamber 52 is defined by the lower end of lower plunger member 48 is cooperation with blind end 42 of bore 40 for retaining oil to maintain the plunger position for lash adjustment. A check valve indicated generally by reference numeral 54 is provided adjacent the end of passage 51 to permit one-way flow of oil from reservoir 50 through passage 51 to chamber 52.

The check valve 54 preferably has a valve seat 56 formed at the junction of passage 51 with the end of lower plunger section 48. The check valve 54 has a movable member 58, preferably a check ball, received therein. The member 58 is movable from a closed position contacting the valve seat 56 to an open position spaced from the valve seat. A cage 60 is received over the check ball and serves to retain the ball therein. A bias spring 62 is provided within the cage to urge the check ball 58 to a closed position in contact with the valve seat 56. A lower plunger member bias spring 64 is provided in the chamber 52 to register against the end of the lower plunger member 48 to urge the plunger means 44 in a direction away from the blind end 42 of bore 40. An annular plunger retainer 65 is provided over the upper end of the lash adjuster body 38, with the upper end of upper plunger member 46 received therethrough. When no load is present on the plunger means from the associated engine valve gear components, the retainer 65 serves to retain the plunger means 44 in the body against the bias force of spring 64.

The upper plunger member 46 is fabricated preferably by the cold heading process and defines a bore 66, a counterbore 68, and a shoulder 70, resulting in a relatively thin walled construction. This feature of the invention permits a significant reduction in material usage as compared to an alternative solid upper plunger design. Further cost savings are realized by a reduction in machining time. A cup-shaped separator member 72 is received in counterbore 68 and is in axial registration and abutment with shoulder 70. A slight interference fit is provided between the outer diameter of separator 72 and counterbore 68 for assembly convenience and sealing. End portions 74 and 76 of the upper and lower plunger members respectively are in abutment. A chamfer 78 is formed on the inner edge of end portion 74 and a chamfer 80 is formed on the inner edge of end portion 76.

Figure 3:
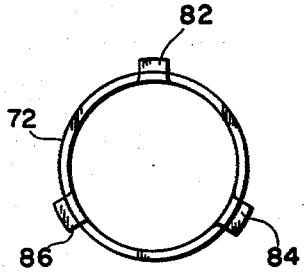
FIG. 3 is a bottom view of the cup-sahped seperator member in FIG. 2.

As illustrated in FIG. 3, separator member 72 includes a plurality of outwardly extending retaining tabs 82, 84 and 86. The outer peripheral surfaces of the retaining tabs conform generally to the surface of chamfer 78 while the bottom edges of the retaining tabs are spaced closely adjacent the surface of chamfer 80, thereby limiting the axial movement of separator member 72 within counterbore 68. Separator member 72 thus forms in cooperation with the upper plunger member and the lower plunger member lower fluid reservoir 50 and an upper fluid reservoir 92. The oil pressure developed within lower fluid reservoir 50 during engine operation urges separator member 72 upward against shoulder 70, thereby effectively fluidly isolating, along with the interference fit on its outer diameter, the upper fluid reservoir from the lower fluid reservoir.

In the preferred practice of the invention, separator member 72 is stamped from untempered SAE 1060 strip stock 0.010 inch (0.254 mm) thick.

Upper plunger member 46 includes an oil entry port 94 located through its side wall and a bleed orifice 96 centrally located through its upper end and exhausting onto reaction surface 49. The thickness of the upper end of upper plunger member 46 is sized so that bleed orifice 96 has a length-to-diameter ratio of approximately 2.5:1 in order to facilitate drilling. The area of bleed orifice 96 is minimized in order to maximize the effective area of reaction surfaces 96, thereby reducing the wear rate of the contacting surfaces on the upper plunger and rocker arm 18.

An oil receiving circumferential groove 98 is provided on the exterior of body 38. A first metering means is formed by an annular metering land 100 located around the periphery of body 38 immediately above receiving groove 98 in cooperation with the wall of bore 12. An annular collector groove 102 is formed on the outer periphery of body 38 and is located above and spaced adjacent metering land 100.

An internal collector groove 104 is formed on the wall of bore 40. An oil entry aperture 106 communicates outer collector groove 102 with internal collector groove 104. A reduced diameter section 108 is provided around the upper end of lower plunger member 48 to provide additional capacity for internal collector groove 104.

A second metering means is formed by an annular metering land 110 formed on the outer periphery of upper plunger member 46 in cooperation with bore 40 and spaced adjacent and above internal collector groove 104. A second internal oil collector groove 112 is formed above annular metering land 110 and functions to receive oil from the second metering means. Oil in groove 112 then flows through entry port 94 to upper fluid reservoir 92 where it then exhausts through bleed orifice 96.

Thus, engine oil entering receiving groove 98 from engine gallery 36 passes through the first metering means formed by metering land 100 and bore 40, into collector groove 102, through oil aperture 106 to oil collector groove 104, through grooves formed in the lower end of the upper plunger or, alternatively, in the upper end of the lower plunger (not shown), and then into lower fluid reservoir 90. A portion of the oil entering collector groove 104 flows through the second metering means in the manner described above.

Although the hydraulic lash adjuster of the present invention has been described as employed in an overhead cam center pivoted rocker arm type valve gear, it will be appreciated that the hydraulic lash adjuster invention may also be employed in other types of valve gear arrangements, for example, cam-over-rocker type or conventional cam-in-block type valve gear having pushrods.

In operation, as the base circle portion of the cam rotates to a position in contact with reaction surface 43 of tappet 10 immediately after valve closing, a small amount of lash or clearance is present in the valve gear during which chamber 52 is unpressurized. At this point the check valve ball permits oil to flow from reservoir 50 into chamber 52. The combined effects of the oil pressure in reservoir 50 and the upward spring force of spring 64 lift the upper and lower plunger away from bore end 42 so that lash is taken out of the valve gear and upper reaction surface 49 is moved in contact with the rocker arm at contact point 26 and the opposite end of the rocker arm is in contact with the upper end of the valve poppet stem at contact point 24. As camshaft 32 continues rotating, cam 30 pushes hydraulic lash adjuster 10 upwardly against the spring biased rocker arm 18, opening valve 16. The resistance transmitted by the rocker arm tends to force the upper and lower plunger sections downward as a unit in a manner which compresses the oil trapped in chamber 52. The check valve 54 then prevents unwanted flow of oil from chamber 52 into reservoir 50 and thus prevents downward movement of the plunger sections. Throughout motion of the tappet 10 the separator member 72 maintains the lower fluid reservoir 50 fluidly isolated from upper fluid reservoir 92 thereby permitting a precise metered flow of lubricating oil to exhaust through bleed orifice 96. A portion of the lubricating oil flowing from bleed orifice 96 passes through an orifice 114 located in the rocker arm adjacent contact point 26 where it then flows between the opposed surfaces of fulcrum 20 and the rocker arm.

The movement of the plunger relative to the lash adjuster body during compensation for lash as described above creates a self cleaning effect between annular metering land 110 and the body bore 40 thus insuring a reliable, clog-resistant, flow of lubricating oil to upper reservoir 92 and bleed orifice 96.

The embodiments of the invention as shown and described above is representative of the inventive principles stated therein. It is to be understood that variations and departures can be made from this embodiment without, however, departing from the scope of the appended claims.

What is claimed is:

1. A hydraulic lash adjuster for a valve gear of an internal combustion engine, comprising:

(a) body means having a blind bore formed therein, said body means including a contact surface adapted to contact associated engine valve gear components for receiving periodically applied forces;

(b) plunger means slidably received in said body bore and defining, in cooperation with the blind end of said bore, a cavity, said plunger means including, (i) means defining a reaction surface adapted to contact associated engine valve gear components and transmit said periodically applied forces, (ii) a lower plunger member having an opening therein;

(iii) an upper plunger member having an opening therein defined by a first internal surface and a first cylindrical surface adjacent the lower end of said upper plunger, said upper plunger further defining a transverse surface portion connecting said first internal surface and said first cylindrical surface, (iv) separator means for fluidly isolating said lower plunger opening from said upper plunger opening, said separator means including a downwardly opening cup shaped member having outer peripheral surface portions in fluid sealing engagement with said first cylindrical surface and said transverse surface portion, said cup-shaped member defining in cooperation with said lower and upper plunger members lower and upper fluid reservoirs, respectively;

(v) one way valve means permitting fluid flow from said lower reservoir to said cavity;

(c) said body means and said plunger means including means for receiving fluid under pressure from said engine and directing said fluid to said upper and lower fluid reservoirs;

(d) said plunger means including means defining a passage communicating said upper reservoir with said reaction surface for directing fluid from said upper fluid reservoir to said reaction surface; and, (e) means biasing said plunger means outwardly of said cavity.

2. The device as defined in claim 1, wherein said cup-shaped member has a plurality of outwardly turned retaining tabs located around the open end thereof, said retaining tabs being in abutment with cooperating surfaces of said upper plunger member.

3. The device defined in claim 1, wherein said plunger means and said body means cooperate to define fluid metering means operative to maintain the fluid in said upper reservoir at a substantially low pressure than the fluid in said lower reservoir.

4. The device defined in claim 1 wherein said metering means includes means defining an annular metering orifice between said body means and said plunger means.

5. A hydraulic lash adjuster for a valve gear of an internal combustion engine, comprising:

(a) body means having a blind bore formed therein, said body means including a contact surface adapted to contact associated engine valve gear components for receiving periodically applied forces;

(b) plunger means slidably received in said body bore and defining, in cooperation with the blind end of said bore, a cavity, said plunger means including, (i) means defining a reaction surface adapted to contact associated ending valve gear components and transmit said periodically applied forces, (ii) means defining upper and lower fluid reservoirs, (iii) one way valve means permitting fluid flow from said lower reservoir to said cavity;

(iv) separator means for fluidly isolating said upper reservoir from said lower reservoir, said separator means including a downwardly opening cup-shaped member having peripheral surface portions in sealing engagement with said plunger means and a plurality of outwardly turned retaining tabs located around the open end thereof, said retaining tabs being in abutment with cooperating surfaces of the wall of said upper reservoir;

(c) said body means and said plunger means including means for receiving fluid under pressure from said engine and directing said fluid to said upper and lower fluid reservoirs;

(d) said plunger means including means defining a passage communicating said upper reservoir with said reaction surface for directing fluid from said upper fluid reservoir to said reaction surface; and (e) means biasing said plunger means outwardly of said cavity.

* * * * *